United States Patent [19]

Sangroni

[11] Patent Number: 4,510,982

[45] Date of Patent: Apr. 16, 1985

[54] BALL CARRIER SYSTEM

[76] Inventor: Roberto Sangroni, 1570 E. New York Ave., Brooklyn, N.Y. 11212

[21] Appl. No.: 546,946

[22] Filed: Oct. 31, 1983

[51] Int. Cl.[3] ..... A63B 47/00; A45C 3/12; A45C 13/26

[52] U.S. Cl. ..... 150/52 A; 190/108; 206/315.1; 206/315.9; 224/209; 224/919; 383/18; 383/37; 383/907

[58] Field of Search ..... 150/52 A; 190/108; 206/315.1, 315.9; 224/151, 153, 209, 210, 919; 383/18, 37, 72, 907, 4

[56] References Cited

U.S. PATENT DOCUMENTS

| | | | |
|---|---|---|---|
| 41,926 | 11/1911 | Hubbell | 150/52 A |
| 1,513,463 | 10/1924 | Kidder | 383/71 |
| 1,927,492 | 9/1933 | Halpin | 206/315.9 X |
| 2,122,171 | 6/1938 | Alexander | 383/4 X |
| 2,510,186 | 6/1950 | Marsico et al. | 383/72 X |
| 2,902,195 | 9/1959 | Marshall | 224/151 |
| 3,583,600 | 6/1971 | Scott | 224/209 X |
| 3,923,222 | 12/1975 | Groves | 383/18 X |
| 3,980,216 | 9/1976 | Nye | 224/209 |
| 4,113,146 | 9/1978 | Williamson | 383/18 X |
| 4,305,584 | 12/1981 | Leehan | 224/919 X |

FOREIGN PATENT DOCUMENTS

| | | | |
|---|---|---|---|
| 605327 | 9/1960 | Canada | 224/153 |
| 1005008 | 12/1951 | France | 224/210 |

*Primary Examiner*—William Price
*Assistant Examiner*—Sue A. Weaver
*Attorney, Agent, or Firm*—Auslander & Thomas

[57] ABSTRACT

A ball carrier system is provided with a ball bag of pliable material configured to receive a spherical ball and to assume a substantially spherical shape and a first cord for carrying the ball bag. The first cord is connected to the ball bag by a plurality of cords on the spherical outside surface of the ball bag extending along major circles from a first common minor circle to a diametrically opposite second common minor circle. The system includes an arcuate gear bag adapted to accept the ball bag for simultaneous carriage of both the ball bag and gear. The system is optionally adapted to hands-free carriage.

15 Claims, 9 Drawing Figures

BALL CARRIER SYSTEM

BACKGROUND OF THE INVENTION

The present invention relates to a ball carrier system and in particular to a ball bag for a spherical ball such as a basketball, a soccer ball and/or a bowling ball.

Ball bags composed of pliable material are known in prior art, as evidenced by U.S. Pat. Nos. 1,513,463, 1,927,492 and 2,850,063. These bags have the disadvantage of only being carried by hand, that is, they are not capable of being used when ridrng on a bicycle or when both hands must be free.

SUMMARY OF THE INVENTION

The main object of the present invention is to eliminate the disadvantages of prior art bags.

These and other objects and advantages of the present invention are achieved in accordance with the present invention by a ball carrier system comprising a ball bag of pliable material configured to receive a spherical ball and which assumes a substantially spherical shape, a first cord for carrying the ball bag and means connecting the first cord to the ball bag comprising a plurality of cords on the spherical outside surface of the ball bag extending along major circles from a first common minor circle to a diametrically opposite second common minor circle. The connecting means preferably comprises a plurality of spaced apart first cord guides connected to the outside surface of the ball bag at said first minor circle for guiding said plurality of cords tangentially to said first minor circle and a plurality of second cord guides connected to the outside surface of the ball bag adjacent to said second minor circle for guiding said plurality of cords tangentially to said major circles.

Each of the plurality of cords preferably comprises a first closed loop at one end passing through one first cord guide, a second closed loop at the other end and a portion connecting the first and second closed loops and passing through one second cord guide and wherein the first cord comprises a third closed loop looped through all but one of the second closed loops and extending completely through the retaining second closed loop. The first cord preferably has an S-clip for releasably connecting one point of the third closed loop to an opposite point thereof.

The bag preferably has an opening which extends along a major circle passing through said second minor circle and means for releasably closing the opening, such as a zipper or Velcro connector.

For use with a heavier ball, such as a bowling ball, a fourth closed loop of cord is provided which extends around the first minor circle and which is connected to each of said first closed loops and wherein the third closed loop is connected at two opposite points and to said fourth closed loop.

In a particularly advantageous embodiment, the system includes a generally arcuate gear bag of pliable material having a top surface configured to extend around a portion of the ball bag at a major circle thereof, a second cord for carrying the gear bag and second means for connecting the second cord to the gear bag, which preferably comprises a plurality of third cord guides on the outer surface of the gear bag and wherein the second cord comprises a closed loop extending through the third cord guides. The gear bag includes an opening in the top surface thereof which is releasably closable by a zipper or the like.

The pliable material of the ball bag and the gear bag comprises leather, plastic such as vinyl, or equivalent luggage material. The cords comprise rope composed of nylon or the like.

Although such novel features believed to be characteristic of the invention are pointed out in the claims, the invention and the manner in which it may be carried out, may be further understood by reference to the description following and the accompanying drawings, wherein:

DETAILED DESCRIPTION OF THE INVENTION

Referring now to the figures in greater detail, where like reference numbers denote like parts in the various figures.

Figure 1:
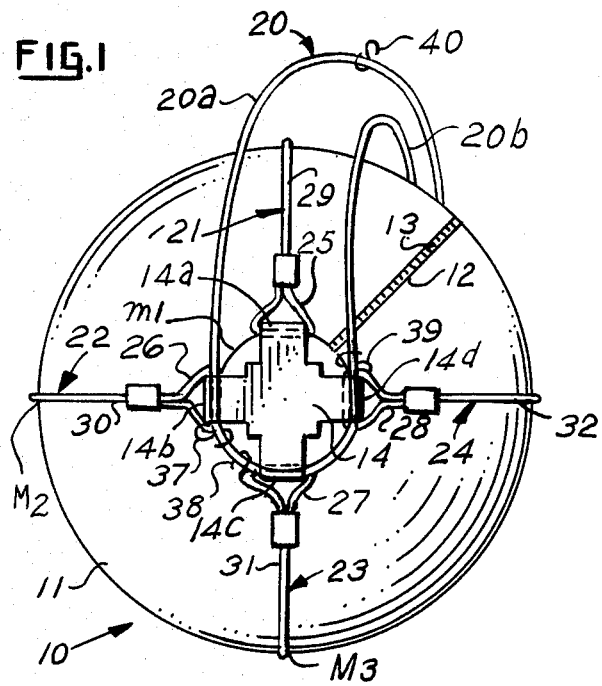
FIG. 1 is a bottom view of the bottom of a ball carrier according to the invention.
Figure 2:
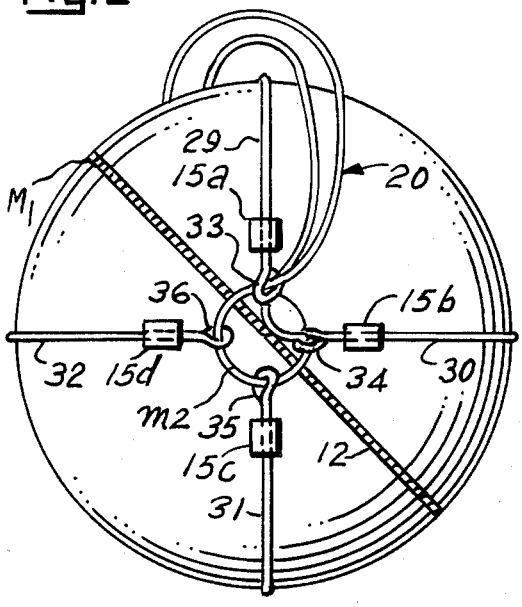
FIG. 2 is a top view of the carrier of FIG. 1.
Figure 3:
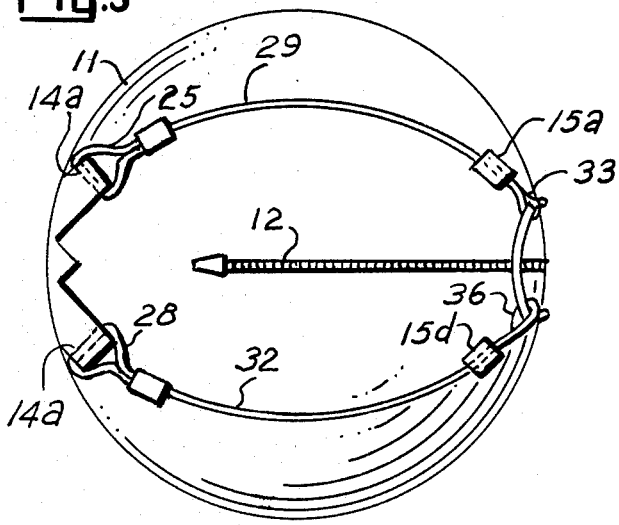
FIG. 3 is a side view of the carrier of FIG. 1.

FIGS. 1–3 show a ball carrier 10 including a ball bag 11 of pliable material such as leather or vinyl having an opening 12 extending almost $\frac{3}{4}$ of the way around a major circle $M_1$ of the bag 11 which assumes a substantially spherical shape when a spherical ball is received therein. The opening is closed by a zipper 13, although other closures such as Velcro can be used.

The bag 11 is held by a cord 20 which is preferably nylon or cotton rope. The cord 20 is connected to bag 11 by means including a plurality of cords 21–24 on the outer surface of bag 11 extending along major circles $M_2$, $M_3$ from a first common minor circle $m_1$ to a diametrically opposite second common minor circle $m_2$. The cords 21–24 are held by a first set of guides **14*a*–14*d* connected to the bag 11 at circle $m_1$ by member 14. The member 14 and guides 14*a–d* are preferably integral and composed of the same pliable material as bag 11. Cords 21–24 are also held by guides 15*a*–15*d* made from the same material as guides 14*a–d* and disposed adjacent to circle $m_2$. Guides 14*a–d* are directed tangentially to circle $m_1$ and guides 15*a–d*** are directed tangentially to circles $M_2$, $M_3$.

The cords 21–24 include first closed loops 25–28 at one end passing through guides **14*a–d* and second closed loops 33–36 at the other end. Portions 29–32 connect loops 25–28 to loops 33–36 respectively and pass through guides 15*a–d*** respectively.

The cord 20 is closed in a loop threaded through loops 34–36 and entirely pulled through the remaining loop 33. The other end of cord 20 can now be held in the hand or rested on ones shoulder to hold the bag 11.

Figure 4:
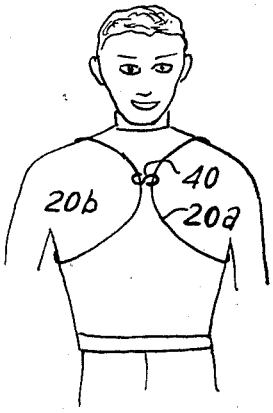
FIGS. 4 and 5 are front and rear views of a person with the carrier mounted in a hand-free manner.
Figure 5:
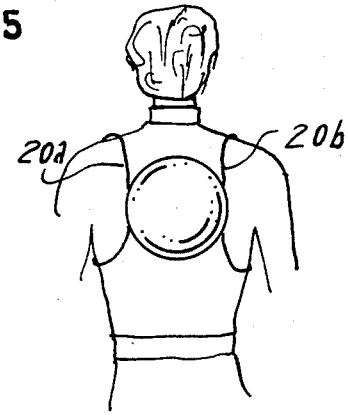

Alternatively, S-clip connectors 37–39 are provided on loops 26–28 and connect to cord 20 as shown in FIG. 1. Portions **20*a* and 20*b* can now be held apart with the arms of an individual looped therethrough as shown in FIGS. 4 and 5. The portions 20*a* and 20*b* are then clipped together by S-clip 40 as shown in FIG. 4** to be fixed in place in a hands-free manner so that a person may ride a bicycle while holding a basketball or soccer ball.

Figure 6:
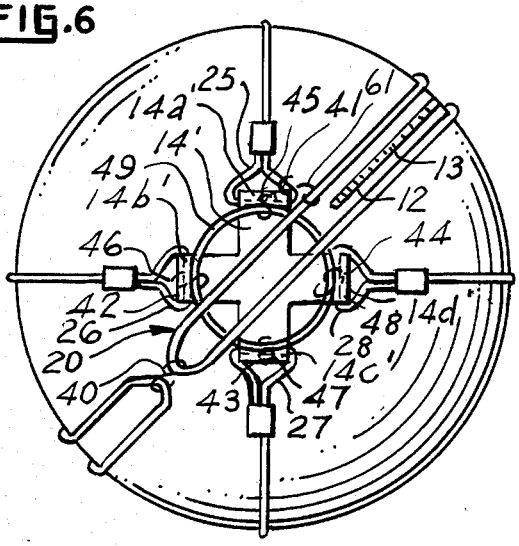
FIG. 6 is a bottom view of an alternative embodiment of a ball carrier according to the invention.

FIG. 6 shows an alternative embodiment for added support so that one may carry a bowling ball which is much heavier than a basketball In this case member 14' has guides **14*a'*–14*d'* with slits 41–44 at the center thereof where S-clips 45–48 are connected to loops 25–28 and to a support loop 49. Preferably, cords of the support loop 49 are composed of the same material as that cords 21–24 an cord 20. Cord 20 is also connected as shown for added support so that it can be held in one's hand while not pulling guides 15*a–d* and 14*a'*–14*d'* off of the surface of bag 11. An S hook 61 is engagable between the loop 25 and cord 20** as shown.

Figure 7:
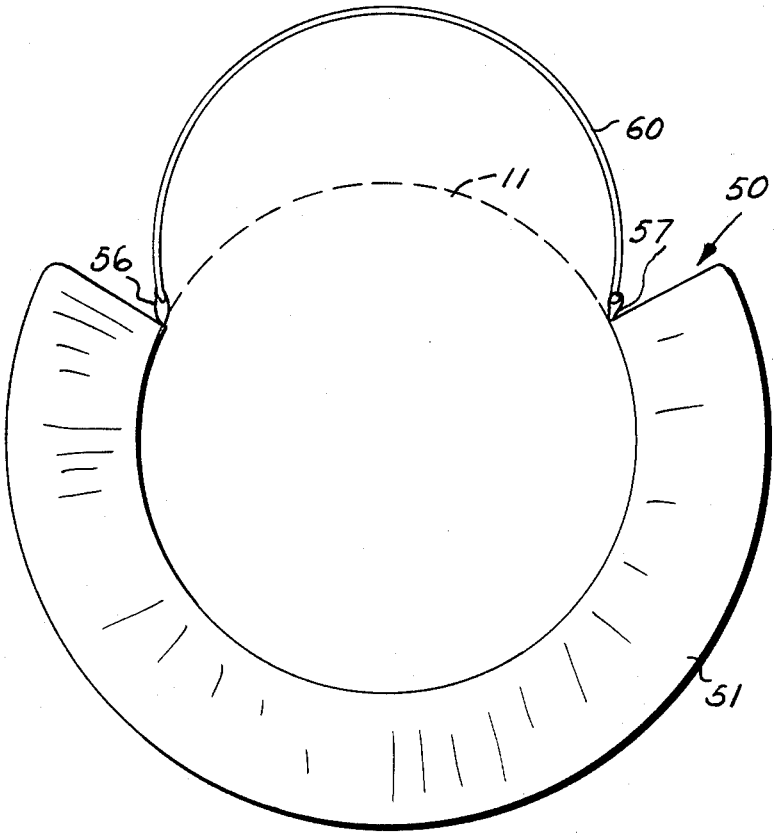
FIG. 7 is a side view of the gear bag for use with the ball carrier of FIGS. 1–5.
Figure 8:
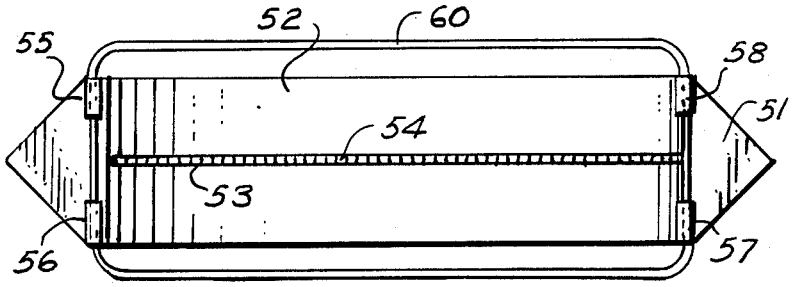
FIG. 8 is a top view of the gear bag of FIG. 7.
Figure 9:
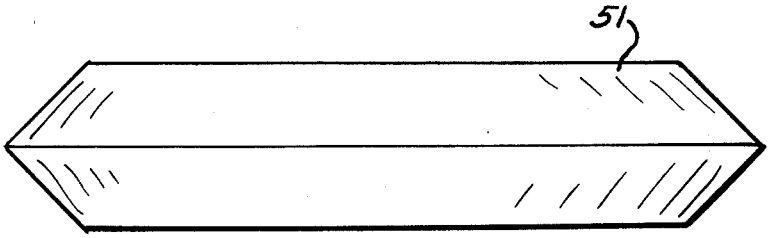
FIG. 9 is a bottom view of the gear bag of FIG. 7.

The system according to the invention also includes gear carrier 50 shown in FIG. 7–9. The carrier 50 includes a generally arcuate gear bag 51 of pliable material, preferably the same as that of bag 11, having a top surface 52 configured to extend around a portion of bag 11 at a major circle thereof.

The top surface 52 has opening 53 for receiving sneakers or other sports clothing and gear and which is closable by zipper 54.

The gear bag 51 is carried by a closed looped cord 60 connected to bag 51 by guides 55–58 which are formed from the same material as bag 51. The cord 60 is composed of the same material as that of cord 20.

The bag 51 is configured to wrap around bag 11 so that the two together can be carried by the cord 60. The cords 20 and 60 may also be adapted to carry the bags 11 and 51 without the use of hands as shown in FIGS. 4 and 5.

The terms and expressions which are employed are used as terms of description, it is recognized though, that various modifications are possible.

It is understood that the following claims are intended to cover all of the generic and specific features of the invention herein described, and all statements of the scope of the invention which, as a matter of language, might fall therebetween.

What is claimed is:

1. A ball carrier system, comprising:

a ball bag of pliable material having an opening and configured to receive a spherical ball therein and thereupon assume a substantially spherical shape;

a first cord for carrying the ball bag; and means connecting the first cord to the ball bag comprising a plurality of cords on the spherical outside surface of the ball bag extending along major circles from a first common minor circle to a diametrically opposite second common minor circle.

2. The system according to claim 1, wherein the connecting means further comprises a plurality of spaced apart first cord guides connected to the outside surface of the ball bag at said first minor circle for guiding said plurality of cords tangentially to said first minor circle and a plurality of second cord guides connected to the outside surface of the ball bag adjacent to said second minor circle for guiding said plurality of cords tangentially to said major circles.

3. The system according to claim 2, wherein each of the plurality of cords comprises a first closed loop at one end passing through one first cord guide, a second closed loop at the other end and a portion connecting the first and second closed loops and passing through one second cord guide and wherein the first cord comprises a third closed loop looped through all but one of the second closed loops and extending completely through the remaining second closed loop.

4. The system according to claim 3, wherein the first cord includes means for releasably connecting one point of the third closed loop to an opposite point thereof.

5. The system according to claim 3, further comprising means for connecting the third closed loop to the first closed loop of the cord having said remaining second closed loop.

6. The system according to claim 1, wherein the opening extends along a major circle passing through said second minor circle and means for releasably closing the opening.

7. The system according to claim 6, wherein the releasable closing means comprises a zipper.

8. The system according to claim 3, wherein the connecting means further comprises a fourth closed loop of cord extending around the first minor circle and means bonnecting the fourth closed loop to each of said first closed loops and wherein the third closed loop is connected at two opposite points and to said first closed loop.

9. The system according to claim 1, further comprising a generally arcuate gear bag of pliable material having a top surface configured to extend around a portion of the ball bag at a major circle thereof, a second cord for carrying the gear bag and second means for connecting thesecond cord to the gear bag.

10. The system according to claim 9, wherein the second connecting means comprises a plurality of third cord guides on the outer surface of the gear bag and wherein the second cord comprises a closed loop extending through the third cord guides.

11. The system according to claim 9, wherein the gear bag includes an opening in the top surface thereof and means for releasably closing said opening.

12. The system according to claim 11, wherein the gear bag releasable closing means comprises a zipper.

13. The system according to claim 9, wherein the pliable material of the ball bag and the gear bag comprises leather.

14. The system according to claim 9, where the pliable material of the ball bag and the gear bag co plastic.

15. The system according to claim 1, the first cord and the plurality of cords comprise rope.

* * * * *